US011317773B2

(12) United States Patent
Hickey

(10) Patent No.: US 11,317,773 B2
(45) **Date of Patent: *May 3, 2022**

(54) DEBRIS COLLECTION DEVICE FOR AUTONOMOUS CLEANING ROBOTS

(71) Applicant: iRobot Corporation, Bedford, MA (US)

(72) Inventor: Stephen A. Hickey, Somerville, MA (US)

(73) Assignee: iRobot Corporation, Bedford, MA (US)

( * ) Notice: Subject to any disclaimer, the term of this patent is extended or adjusted under 35 U.S.C. 154(b) by 591 days.

This patent is subject to a terminal disclaimer.

(21) Appl. No.: 16/235,945

(22) Filed: Dec. 28, 2018

(65) Prior Publication Data

US 2020/0205626 A1 Jul. 2, 2020

(51) Int. Cl.
*A47L 9/14* (2006.01)
*A47L 9/06* (2006.01)

(52) U.S. Cl.
CPC ..... *A47L 9/0686* (2013.01); *A47L 9/0606* (2013.01); *A47L 9/0673* (2013.01); *A47L 9/1418* (2013.01); *A47L 9/1427* (2013.01); *A47L 9/1481* (2013.01); *A47L 2201/04* (2013.01)

(58) Field of Classification Search
CPC ..... A47L 9/14; A47L 9/04; A47L 9/06; A47L 9/1418
See application file for complete search history.

(56) References Cited

U.S. PATENT DOCUMENTS

| | | | | |
|---|---|---|---|---|
| 1,066,201 | A | 7/1913 | Fulper | |
| 1,978,579 | A * | 10/1934 | Theo | A47L 13/254 15/403 |
| 7,137,169 | B2 * | 11/2006 | Murphy | A47L 5/24 15/320 |
| 10,918,251 | B2 | 2/2021 | Hickey | |
| 2002/0111127 | A1 | 8/2002 | Tseng | |
| 2005/0005389 | A1 * | 1/2005 | Rau | A47L 11/2025 15/320 |
| 2007/0062000 | A1 * | 3/2007 | Murphy | A47L 5/28 15/403 |
| 2011/0239599 | A1 | 10/2011 | Woo | |
| 2015/0250368 | A1 * | 9/2015 | Kim | A47L 9/0686 15/347 |

(Continued)

OTHER PUBLICATIONS

"U.S. Appl. No. 16/879,422, Response filed Sep. 8, 2020 to Restriction Requirement dated Jul. 17, 2020", 8 pgs.

(Continued)

*Primary Examiner* — Michael D Jennings
(74) *Attorney, Agent, or Firm* — Schwegman Lundberg & Woessner, P.A.

(57) ABSTRACT

The present disclosure provides, in one aspect, a debris collection device for an autonomous cleaning robot includes a cleaning pad portion configured to contact a floor surface. The cleaning pad portion includes a backing and at least one cleaning pad connected to a bottom surface of the backing. The autonomous cleaning robot includes a vacuum bag portion configured to collect at least a portion of debris removed from the floor surface by a vacuum assembly of the autonomous cleaning robot. A volume of the vacuum bag portion is positioned vertically above the cleaning pad portion.

19 Claims, 4 Drawing Sheets

(56) References Cited

U.S. PATENT DOCUMENTS

2020/0281426 A1 9/2020 Hickey

OTHER PUBLICATIONS

"U.S. Appl. No. 16/879,422, Non Final Office Action dated Sep. 24, 2020", 12 pgs.
"U.S. Appl. No. 16/879,422, Examiner Interview Summary dated Oct. 20, 2020", 4 pgs.
"U.S. Appl. No. 16/879,422, Response filed Oct. 21, 2020 to Non Final Office Action dated Sep. 24, 2020", 13 pgs.
"U.S. Appl. No. 16/879,422, Notice of Allowance dated Dec. 23, 2020", 7 pgs.

* cited by examiner

DEBRIS COLLECTION DEVICE FOR AUTONOMOUS CLEANING ROBOTS

TECHNICAL FIELD

This specification relates to debris collection devices for autonomous cleaning robots.

BACKGROUND

Cleaning robots include mobile robots that autonomously perform cleaning tasks within an environment, e.g., a home. Many kinds of cleaning robots are autonomous to some degree and in different ways. The cleaning robots can autonomously navigate about the environment and ingest and/or collect debris as they autonomously navigate the environment. The debris is often stored in cleaning bins that can be manually removed from the cleaning robots so that debris can be emptied from the cleaning bins.

SUMMARY

Described herein is a debris collection device for an autonomous cleaning robot. The debris collection device includes a cleaning pad portion configured to collect debris from a floor surface and a vacuum bag portion configured to trap debris removed from the floor surface by an airflow produced by a vacuum assembly in the autonomous cleaning robot. The debris collection device allows for more efficient cleaning as the autonomous cleaning robot may pick up larger debris (e.g., by ingesting debris with the vacuum assembly and trapping the ingested debris in the vacuum bag portion) and smaller debris (e.g., with the cleaning pad portion) simultaneously. Additionally, the debris collection device may be ejected from the autonomous cleaning robot after cleaning is completed, allowing the user to avoid contacting debris removed from the floor surface during cleaning.

In one aspect, a debris collection device for an autonomous cleaning robot includes a cleaning pad portion configured to contact a floor surface, the cleaning pad portion comprising a backing and at least one cleaning pad connected to a bottom surface of the backing. The debris collection device also includes a vacuum bag portion configured to collect at least a portion of debris removed from the floor surface by a vacuum assembly of the autonomous cleaning robot, wherein a volume of the vacuum bag portion is positioned vertically above the cleaning pad portion.

In some implementations, the at least one cleaning pad comprises a stack of removable cleaning pads. In some instances, the volume of the vacuum bag portion is sized with respect to a number of individual cleaning pads included in the stack of removable cleaning pads of the cleaning pad portion. In some instances, the volume of the vacuum bag portion is between approximately 320 mL and 1080 mL. In some instances, the stack of removable cleaning pads comprises between 3 and 5 individual cleaning pads.

In some implementations, when expanded, the vacuum bag portion has a height between approximately 40 mm and 60 mm.

In some implementations, when expanded, the vacuum bag portion has a rectangular geometry.

In some implementations, the vacuum bag portion is configured to separate and capture debris from an air flow generated by the vacuum assembly.

In some implementations, the vacuum bag portion comprises a cloth material.

In some implementations, the vacuum bag portion comprises a collar comprising an inlet, wherein the inlet is configured to be positioned approximately perpendicular to a bottom surface of the cleaning pad portion when the debris collection device is positioned in the autonomous cleaning robot. In some instances, the collar is configured to be received by a slot of the autonomous cleaning robot to secure the debris collection device in the autonomous cleaning robot. In some instances, the debris collection device is configured to be released from the autonomous cleaning robot when the collar is released from the slot. In some instances, a front edge of the cleaning pad portion is positioned in front of the inlet of the vacuum bag portion.

In some implementations, the vacuum bag portion is positioned on an upper surface of the backing of the cleaning pad portion. In some instances, the cleaning pad portion comprises a foam material below the backing. In some instances, the backing is configured to receive and disperse a downward force from the autonomous cleaning robot across the cleaning pad portion.

In another aspect, an autonomous cleaning robot includes a drive configured to move the autonomous cleaning robot across a floor surface, a vacuum assembly configured to remove debris from the floor surface, and a debris collection device. The debris collection device includes a cleaning pad portion configured to contact the floor surface, the cleaning pad portion comprising a backing and at least one cleaning pad connected to a bottom surface of the backing. The debris collection device also includes a vacuum bag portion in pneumatic communication with the vacuum assembly and configured to collect at least a portion of debris removed from the floor surface by the vacuum assembly, wherein a volume of the vacuum bag portion is positioned vertically above the cleaning pad portion.

In some implementations, the autonomous cleaning robot also includes a cavity configured to receive the vacuum bag portion of the debris collection device.

In some implementations, the autonomous cleaning robot also includes a slot configured to receive a collar of the debris collection device to secure the debris collection device in the autonomous cleaning robot.

In some implementations, the at least one cleaning pad comprises a stack of removable cleaning pads. In some instances, the stack of removable cleaning pads comprises between 3 and 5 individual cleaning pads. In some instances, the volume of the vacuum bag portion is sized with respect to a number of individual cleaning pads included in the stack of removable cleaning pads of the cleaning pad portion.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Described herein is a debris collection device for an autonomous cleaning robot. The debris collection device includes a cleaning pad portion configured to collect debris from a floor surface and a vacuum bag portion configured to trap debris removed from the floor surface by an airflow produced by a vacuum assembly in the autonomous cleaning robot. The debris collection device allows for more efficient cleaning as the autonomous cleaning robot may pick up larger debris (e.g., by the vacuum assembly that will be collected in the vacuum bag portion) and smaller debris (e.g., by the cleaning pad portion) simultaneously. Additionally, the debris collection device may be removed from the autonomous cleaning robot after cleaning is completed, allowing the user to avoid contacting debris removed from the floor surface during cleaning.

Figure 1:
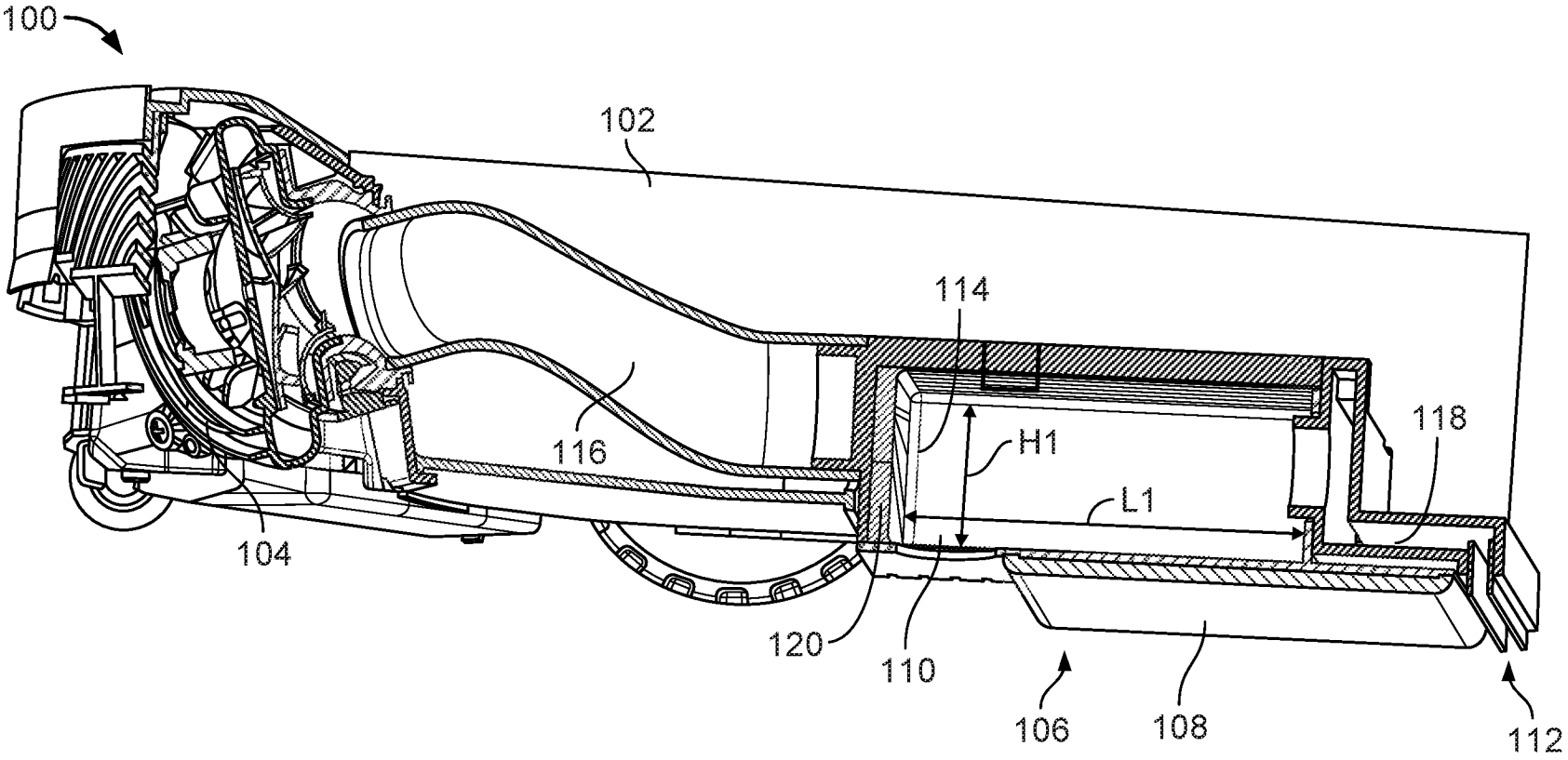
FIG. 1 is a perspective view of an autonomous cleaning robot with a debris collection device including a cleaning pad portion and a vacuum bag portion.

Referring to FIG. 1, an autonomous cleaning robot 100 includes a robot body 102 and a vacuum assembly 104 configured to remove debris from a floor surface as it navigates across the floor surface. In some implementations, the robot body 102 generally has an overall square shape. However, the robot body 102 may have other shapes, including but not limited to a circular shape, an oval shape, a tear drop shape, a rectangular shape, a combination of other shapes (a square or rectangular front and a circular back), a longitudinally asymmetrical combination of any of these shapes, etc.

The robot body 102 is configured to retain a debris collection device 106. The debris collection device 106 supports a forward portion of the robot body 102 as the autonomous cleaning robot 100 navigations about the floor surface. The debris collection device 106 includes a cleaning pad portion 108 and a vacuum bag portion 110. The vacuum assembly 104 is in pneumatic communication with a vacuum inlet 112 positioned in front of the debris collection device 106. An airflow created by the vacuum assembly 104 flows from the floor surface, where debris is collected, through the vacuum inlet 112 and proceeds through an inlet conduit 118 through an inlet 114 into the vacuum bag portion 110 of the debris collection device 106. At least a portion of the debris removed from the floor surface is separated from the airflow in the vacuum bag portion 110. In some implementations, the vacuum bag portion 110 acts as a filter to remove debris from the airflow as the airflow passes therethrough. The airflow continues out of a rear opening in a cavity 120 of the body 102 of the autonomous cleaning robot that retains the debris collection device 106. The rear opening connects to a vacuum conduit 116, which is in pneumatic communication with the vacuum assembly 104.

The vacuum bag portion 110 of the debris collection device 106 is configured to expand to a rectangular shape approximately equal to a volume of the cavity 120. The interior of the vacuum bag portion 110 has a height H1 and a length L1. The height H1 may be between approximately 40 and 60 mm. The length L1 may be between approximately 100 and 150 mm. The interior of the vacuum bag portion 110 also has a width W1 (shown in FIG. 3), which may be between 80 and 120 mm. Therefore, the interior volume of the vacuum bag portion is approximately between 320 and 1080 mL.

Figure 2:
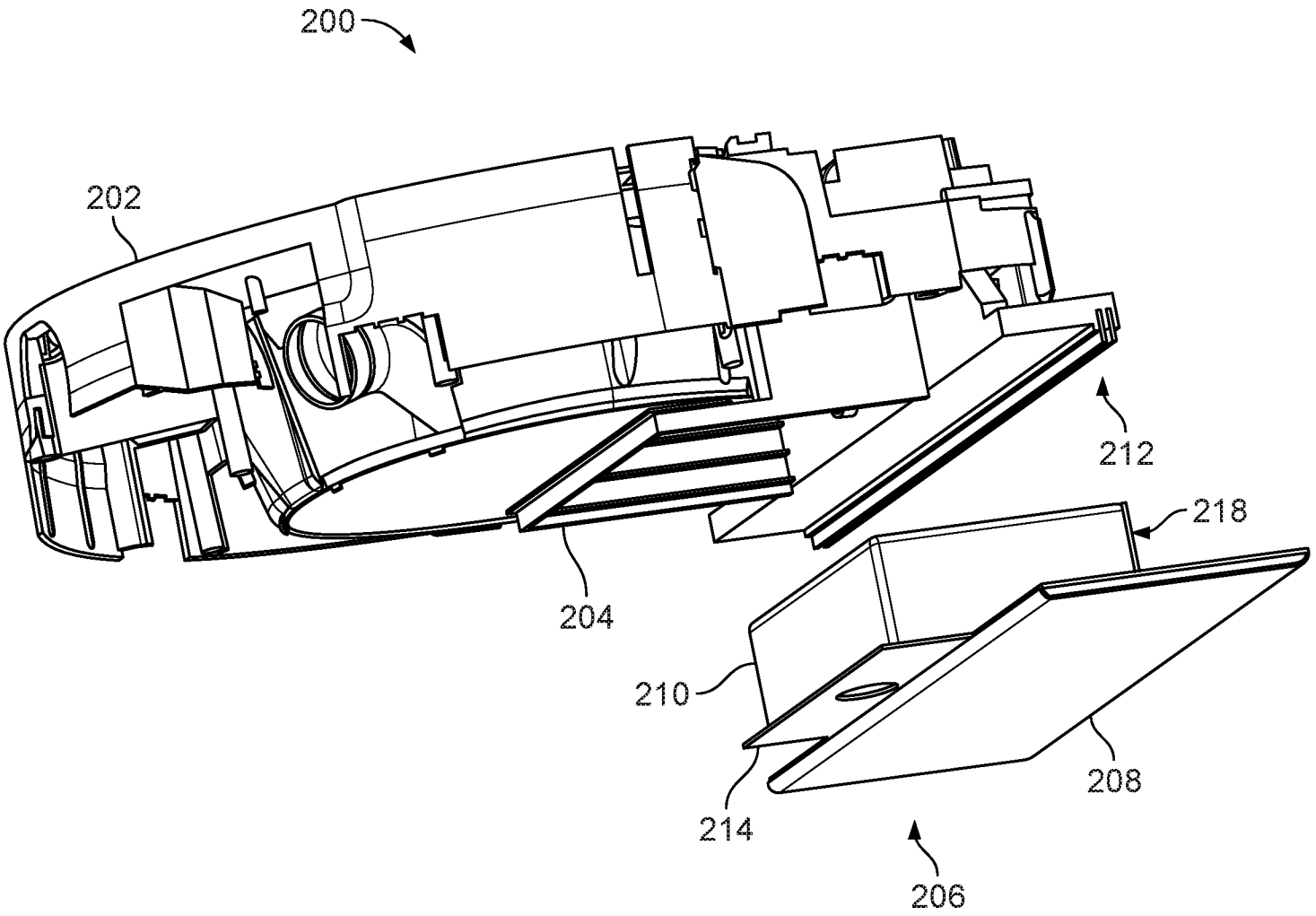
FIG. 2 is a perspective view of the autonomous cleaning robot of FIG. 1 with the debris collection device removed from a body of the autonomous cleaning robot.

Referring to FIG. 2, an autonomous cleaning robot 200 includes a body 202 and a debris collection device 206 that is separable from the body 202. The body 202 includes a cavity 204 configured to receive the debris collection device 206. The cavity 204 is positioned behind a vacuum inlet 212 configured to allow removal of debris from the floor surface by a vacuum assembly (not shown, see vacuum assembly 104 in FIG. 1) in pneumatic communication with the vacuum inlet 212. The debris collection device includes a cleaning pad portion 208 and a vacuum bag portion 210. The vacuum bag portion 210 is configured to expand to a rectangular shape approximately equal to a volume of the cavity 204.

The cleaning pad portion 208 and the vacuum bag portion 210 are separated by a backing 214. The backing 214 may be formed from a stiff material, e.g., cardboard, plastic, etc., and may extend across a top portion of the cleaning pad portion 208 (e.g., to a leading edge of the cleaning pad portion 208). The backing 214 provides a base for the vacuum bag portion 210 and a surface across which a downward force from the robot body 202 may be distributed. The distributed downward force allows the cleaning pad portion 208 to more evenly contact the floor surface during a cleaning mission. Additionally, the downward force from the robot body 202 on the cleaning pad portion 208 allows the cleaning pad portion 208 to scrub the floor surface during the cleaning mission.

The vacuum pad portion 210 includes a collar 218 configured to be held in the cavity 204 of the body 202. For example, in some implementations, the collar 218 may slide and be clipped into a slot in the cavity 204. The autonomous cleaning robot 200 may include a button configured to release the collar 218 from the cavity, thereby allowing the debris collection device 206 to be removed from the autonomous cleaning robot 200. In some implementations, pressing the button causes the collar 218 to be released and the debris collection device 206 to fall out of the cavity 204 by the force of gravity alone.

Figure 3:
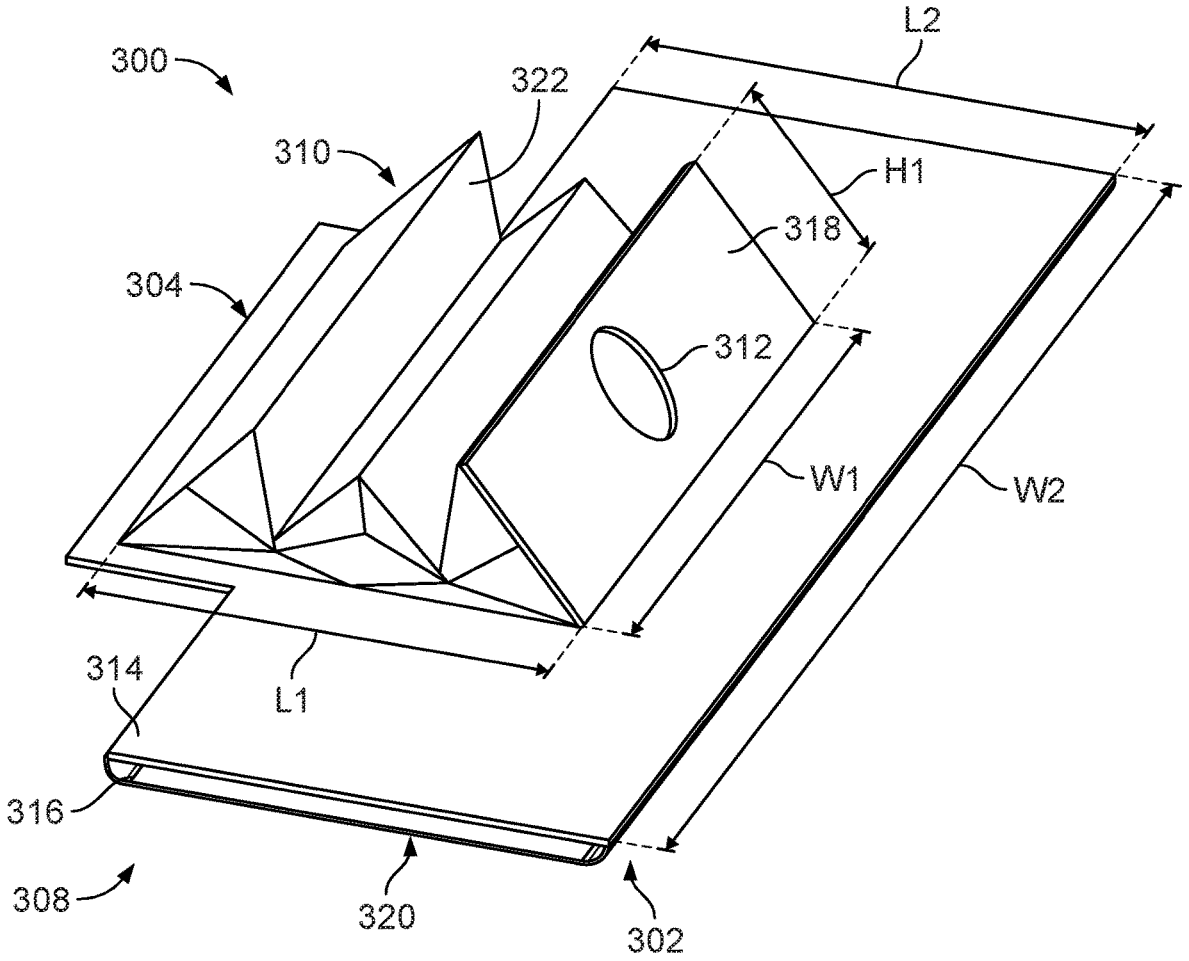
FIG. 3 is a perspective view of the debris collection device of FIG. 2.

Referring to FIG. 3, a debris collection device 300 including a collapsible vacuum bag portion 310 and a cleaning pad portion 308 is shown. The debris collection device 300 can be disposable, e.g., after the debris collected in a vacuum bag portion 310 and on a cleaning pad portion 308 has exceeded a certain debris capacity. In some implementations, the autonomous cleaning robot 200 may include a flap that can remain closed when the debris collection device 300 is removed from the autonomous cleaning robot. The flap may cover access to the vacuum conduit 116, which is in pneumatic communication with the vacuum assembly 104. In such an implementation, when the vacuum assembly 104 generates a vacuum, the flap can be opened to allow pneumatic communication with the vacuum bag portion 310 of the debris collection device 300.

A vacuum bag 322 of the vacuum bag portion 310 at least partially forms a receptacle for debris and is formed of a material through which air can travel. The material of the vacuum bag 322 is selected such that the vacuum bag 322 can serve as a separator that filters at least a portion of the debris out of the airflow generated by the vacuum assembly 104. For example, the vacuum bag 322 can be formed of paper, fabric, etc. that allows air to pass through but traps dirt and debris and thereby retains the debris within the interior of the vacuum bag 322. The material of the vacuum bag 322 is flexible, enabling the vacuum bag 322 to be folded and easily stored. In addition, the vacuum bag 322 can expand to accommodate additional debris as the vacuum bag 322 collects debris during a cleaning operation. The vacuum bag 322, while collecting debris via filtration, is porous to permit the airflow to exit the vacuum bag 322 with an amount of debris that is considerably less than the amount of debris suspended by the airflow as the airflow enters the vacuum bag 322. For example, the vacuum bag 322 can collect debris having a width greater than 1 micrometer, e.g., greater than 3 micrometers, 10 micrometers, 50 micrometers, or more.

The cleaning pad portion 308 and the vacuum bag portion 310 are separated by a backing 314. The backing 314 is made from a stiff material, for example, cardboard, plastic, etc. The backing 314 provides support for the cleaning pad portion 308 and allows a downward force, transferred by the body 202 of the autonomous cleaning robot 200, to be distributed across the cleaning pad portion 308. Additionally, a collar 318 is connected to and supported by the backing 314. The collar 318 includes an opening 312 to the vacuum bag 322. The collar 318 is collapsible and may be configured to lay flat against the backing 314. For insertion into the cavity 204 of the autonomous cleaning robot 200, the collar 318 is positioned approximately perpendicular to the backing 314. As discussed above, the collar 318 may be clipped, or otherwise held, in position in the body 202 of the autonomous cleaning robot 100 during a cleaning mission.

On an underside of the backing 314, the cleaning pad portion 308 may include a flexible layer, e.g., foam 316, to provide support to a cleaning pad 320. The foam 316 may also aid in distributing the downward force from the body 202 of the autonomous cleaning robot 200 across the surface of the cleaning pad 320. Additionally, the foam 316 may help to dampen movements, e.g., vertical movements from bumps experienced by the cleaning pad 320 as the cleaning pad 320 moves across the floor surface. By dampening vertical motions, the cleaning pad 320 may have an increased level of contact with the floor surface during the cleaning mission.

The cleaning pad portion 308 is approximately rectangular in shape. The cleaning pad portion 308 has a width W2 of between approximately 250 and 300 mm and a length L2 of between approximately 80 and 100 mm. A portion of the vacuum bag portion 310 is positioned on a portion of the backing 314 on top of the cleaning pad portion 308 and another portion of the vacuum bag portion 310 is positioned on a portion of the backing 314 that extends behind the cleaning pad portion 308. The vacuum bag portion 310 has a width W1 of between approximately 80 and 120 mm and a length L1 of between approximately 100 and 150 mm. Additionally, as shown in FIG. 1, the vacuum bag portion 310 has a height H1 of between approximately 40 and 60 mm. As such, a volume of the vacuum bag 322 is between approximately 320 and 1080 mL. The vacuum bag 322 may be segmented to allow for easier collapsibility of the vacuum bag. For example, the vacuum bag 322 has three segments with a front segment (which includes the collar 318) and a back segment being configure to fold toward a middle segment.

The collar 318 is positioned approximately parallel to a front edge 302 and a rear edge 304 of the cleaning pad portion 310. Force from the body 202 of the autonomous cleaning robot 200 may be transferred through the collar 318, which may be made of a rigid material, e.g., cardboard, plastic, etc. Force may be transferred from the collar 318 across the backing 314 to be distributed across the cleaning pad portion 308 of the debris collection device 300. In some implementations, additional force transferring members, e.g., support structures, may be included in the debris collection device 300. For example, as the vacuum bag 322 is positioned on top of the backing 314, a portion of the backing 314 beneath the vacuum bag may not receive a direct downward force from a portion of the body 202 of the autonomous cleaning robot. To distribute the downward force experienced by the debris collection device 300 across the portion of the backing 314 beneath the vacuum bag 322, support structures may be positioned between the backing 314 and the vacuum bag 322 and may extend across the width and/or length of the vacuum bag 322. For example, a support structure formed of crossing rigid plastic members may be positioned beneath the vacuum bag 322 to transfer downward force to the portion of the cleaning pad portion 308 beneath the vacuum bag 322.

Figure 4:
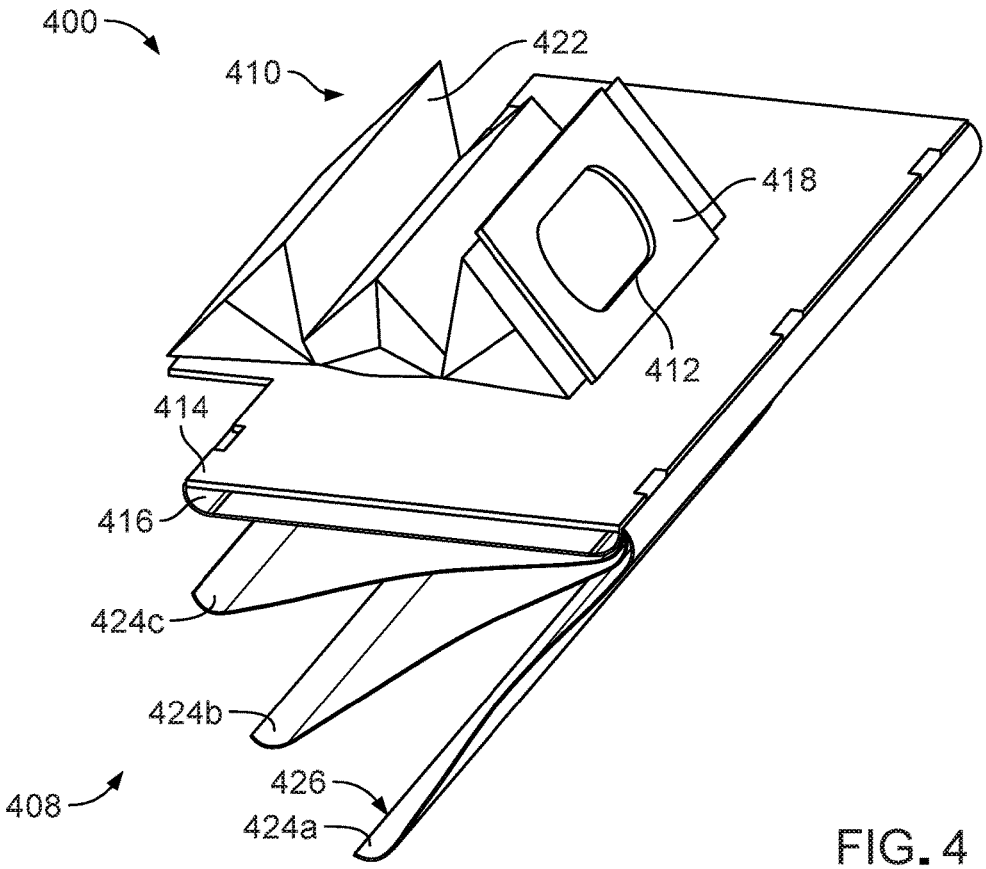
FIG. 4 is a perspective view of a debris collection device including multiple cleaning pads.

Referring to FIG. 4, a debris collection device 400 includes a cleaning pad portion 408 and a vacuum bag portion 410. The cleaning pad portion 408 includes a stack of individual cleaning pads 424*a*, 424*b*, 424*c*. The individual cleaning pads 424*a-c* are stacked against a bottom surface of a foam layer 416, which is supported by a backing 414. Some implementations may include more or less individual cleaning pads (e.g., 1, 2, 4, 5, etc.) than the three individual cleaning pads 424*a-c* shown in FIG. 4. The individual cleaning pads 424*a-c* are separately removable from the debris collection device 400. In some implementations, the individual cleaning pads 424*a-c* are adhered or otherwise removably connected to one another such that one individual cleaning pad (e.g., top individual pad 424*a*) may be removed from the cleaning pad portion 408 at a time for disposal. In one implementation, each individual cleaning pad 424*a-c* includes a tab on an edge of the individual cleaning pad 424*a-c* that can be pulled by a user to remove the cleaning pad 424*a-c* without touching the portion of the cleaning pad contacting the floor surface during the cleaning mission. For example, edge 426 on individual cleaning pad 424*c* may include a tab. In some implementations, the tabs on each individual cleaning pad 424*a-c* may be stacked such that a tab of a bottom individual cleaning pad 424*c* (i.e., a cleaning pad in the stack that is farthest away from the foam layer 414) is at least partially covering a tab of another individual cleaning pad 424*a* or 424*b* that is closer to the foam layer 414.

Similar to the implementation shown in FIG. 3, the debris collection device 400 includes a vacuum bag portion 410 including a flexible, collapsible vacuum bag 422 and a collar 418 including an opening 412 to the vacuum bag 422. The vacuum bag 422 is expandable into a rectangular geometry and is configured to collect debris from an airflow passing therethrough.

The debris collection device 400 can be disposable, e.g., after the debris collected in a vacuum bag portion 410 and on a cleaning pad portion 408 has exceeded a certain debris capacity of either the vacuum bag portion 410 or the cleaning pad portion 408. In some implementations, the debris capacity of the vacuum bag portion 410 (i.e., the volume of the vacuum bag 422) is sized in view of a number of individual cleaning pads 424*a-c* of the cleaning pad portion 408. This sizing allows the vacuum bag 422 to become full after approximately the same amount of cleaning time as a debris capacity of the last individual cleaning pad 424*c*, is reached. The sizing also allows for efficient use of a debris collection device 400 such that substantially all of the debris capacity of the vacuum bag 422 and the cleaning pad portion 308 is used prior to disposal of the debris collection device 400. In some implementations, the volume of the vacuum bag 422 is between 320 mL and 1080 mL and the debris collection device 400 includes between 1 and 10 individual cleaning pads. For example, in one implementation, a vacuum bag with a volume of approximately 320 mL includes 1 individual cleaning pad. In another implementation, a vacuum bag with a volume of approximately 1080 mL includes 10 individual cleaning pads. In some implementations, the debris collection device 400 includes between 3 and 5 cleaning pads. In some implementations, a debris collection device that includes 3-5 cleaning pads has a volume of approximately between 400 and 800 mL. In some implementations, a debris collection device that includes 1-3 cleaning pads has a volume of approximately 320 mL to 600 mL. In some implementations, a debris collection device that includes 5-10 cleaning pads has a volume of approximately 700 mL to 1080 mL. In some implementations, an individual cleaning pad is added to the stack for each 80-85 mL of volume of the vacuum bag 422 above a minimum volume of 320 mL (e.g., volumes between 320 and 400 mL include 1 cleaning pad, volumes between 400 and 480 mL include 2 cleaning pads, volumes between 480 and 560 mL include 3 cleaning pads, etc.).

Figure 5:
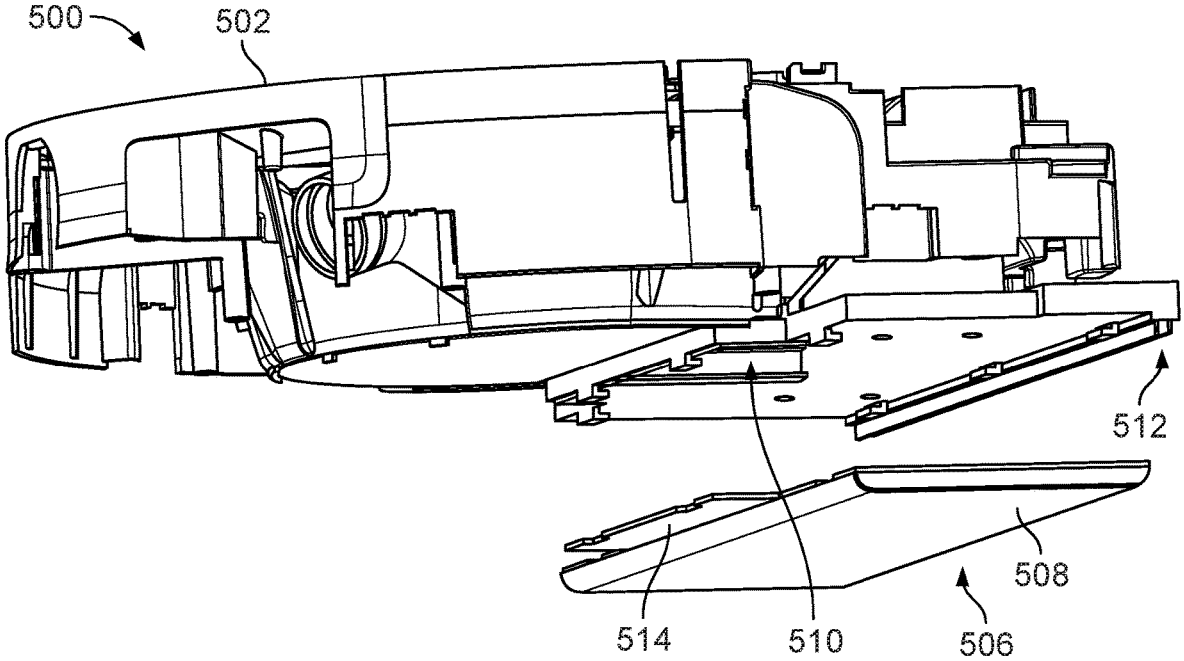
FIG. 5 is a perspective view of an autonomous cleaning robot with a debris collection device including a cleaning pad portion.

Referring to FIG. 5, an autonomous cleaning robot 500 includes a robot body 502 and a debris collection device 506. The body 502 of the autonomous cleaning robot 500 includes a vacuum inlet 512 in pneumatic communication with a vacuum assembly (not shown, similar to vacuum assembly 104 of FIG. 1). Debris is configured to be captured by an airflow generated by the vacuum assembly and pass through the vacuum inlet 512. The vacuum inlet 512 is in pneumatic communication with a cavity 510 configured to collect debris from the airflow. The cavity 510 may include a filter (not shown) for separating debris from the airflow.

The debris collection device 506 of the autonomous cleaning robot 500 includes a cleaning pad portion 508 mounted on a backing 514. The cleaning pad portion 508 is positioned below the cavity 510 that is configured to collect debris from the airflow. The debris collection device 506 is configured to seal to the cavity 510 such that pneumatic communication between the vacuum assembly and the vacuum inlet 512 is maintained via the cavity 510. The cleaning pad portion 508 is configured to contact a floor surface and collect debris from the floor surface via this contact. During a cleaning mission, as debris removed from the floor surface by the airflow collects in the cavity 510, debris collects on a surface of the cleaning pad portion 508 of the debris collection device 506.

The debris collection device 506 is configured to be releasably attached to the body 502 of the autonomous cleaning robot 500 such that removal of the debris collection device allows debris collected in the cavity 510 to fall out of the bottom of the body 502. For example, as the debris collection device 506 forms a bottom surface of the cavity 510, when the debris collection device is removed from the body 502, the debris collected in the cavity 510 is also removed. This configuration allows for all debris collected by the autonomous cleaning robot 500, whether on the cleaning pad portion 508 or in the cavity 510, to be simultaneously removed. In some implementations, the debris collection device 506 may be hingedly attached to the body 502 such that the debris collection device 506 swings downward from the body 502 and allows the cavity 510 to be emptied. The debris collection device 506 may be reattached to the body 502 such that a new debris collection device 506 is not required to be used each time the cavity 510 is emptied.

In an alternative implementation, a debris collection device includes a vacuum bag portion and a cleaning pad portion where the vacuum bag portion and the cleaning pad portion are integrally formed. For example, a vacuum bag of the vacuum bag portion may be made of a fabric material configured to allow air to flow therethrough, but also configured to contact a floor surface and remove debris from the floor surface. In such an implementation, a bottom surface of the vacuum bag may be configured to contact the floor surface and form the cleaning pad portion of the debris collection device. As mentioned above with respect to FIG. 3, support structures may be included in the debris collection device to distribute downward force from the weight of the autonomous cleaning robot across the cleaning pad portion to provide even contact across a surface area of the cleaning pad.

A number of implementations have been described. Nevertheless, it will be understood that various modifications may be made. Accordingly, other implementations are within the scope of the claims.

What is claimed is:

1. A debris collection device for a cleaning device, the debris collection device comprising:

a cleaning pad portion configured to contact a floor surface; and a vacuum bag portion attached to the cleaning pad portion, the vacuum bag portion being configured to collect at least a portion of debris removed from the floor surface by a vacuum assembly of the cleaning device;

wherein a volume of the vacuum bag portion is located vertically above the cleaning pad portion.

2. The debris collection device of claim 1, wherein the vacuum bag portion includes a rigid portion at least partially defining the volume of the vacuum bag portion.

3. The debris collection device of claim 2, wherein the rigid portion is configured to transfer force from the cleaning device to the cleaning pad portion.

4. The debris collection device of claim 1, wherein the vacuum bag portion is segmented to provide for expandability.

5. The debris collection device of claim 4, wherein the vacuum bag portion includes:

a middle segment;

a front segment connected to the middle segment and configured to fold toward the middle segment; and a back segment connected to the middle segment and configured to fold toward the middle segment.

6. The debris collection device of claim 1, wherein the vacuum bag portion comprises a collar comprising an inlet, wherein the inlet is configured to be positioned approximately perpendicular to a bottom surface of the cleaning pad portion when the debris collection device is positioned in the cleaning device.

7. The debris collection device of claim 6, wherein the collar is configured to be received by a slot of the debris collection device to secure the debris collection device in the cleaning device.

8. The debris collection device of claim 6, wherein the debris collection device is configured to be released from the cleaning device when the collar is released from the slot.

9. The debris collection device of claim 6, wherein a front edge of the cleaning pad portion is positioned in front of the inlet of the vacuum bag portion.

10. The debris collection device of claim 1, wherein the vacuum bag portion is positioned on an upper surface of the backing of the cleaning pad portion.

11. The debris collection device of claim 10, wherein the backing is configured to receive and disperse a downward force from the cleaning device across the cleaning pad portion.

12. A cleaning device comprising:

a vacuum assembly configured to remove debris from the floor surface; and a debris collection device, comprising:

a cleaning pad portion configured to contact the floor surface; and a vacuum bag portion in pneumatic communication with the vacuum assembly and configured to collect at least a portion of debris removed from the floor surface by the vacuum assembly;

wherein a volume of the vacuum bag portion is located vertically above the cleaning pad portion.

13. The cleaning device of claim 12, further comprising a cavity configured to receive the vacuum bag portion of the debris collection device.

14. The cleaning device of claim 12, wherein the vacuum bag portion includes:

a middle segment;

a front segment connected to the middle segment and configured to fold toward the middle segment; and a back segment connected to the middle segment and configured to fold toward the middle segment.

15. The debris collection device of claim 12, further comprising:

a flap configured to cover access to the vacuum assembly when the vacuum bag portion is removed from the cleaning device.

16. The debris collection device of claim 12, wherein the vacuum bag portion includes a rigid portion at least partially defining the volume of the vacuum bag portion.

17. The debris collection device of claim 16, further comprising:

a button engageable with the rigid portion to secure to the debris collection device to the cleaning device, the button operable to release the rigid portion from the button to release the debris collection device to fall from the cleaning device by a force of gravity.

18. A debris collection device for a cleaning device, the debris collection device comprising:

a cleaning pad configured to contact a floor surface; and a vacuum bag connected to the cleaning pad, the vacuum bag configured to collect at least a portion of debris removed from the floor surface by a vacuum assembly of the cleaning device, the vacuum bag defining a volume therein that is positioned vertically above the cleaning pad portion, and wherein cleaning pad and the vacuum bag are integrally formed.

19. The debris collection device of claim 18, wherein the vacuum bag is located on top of the cleaning pad.

* * * * *